US008641441B2

(12) United States Patent
Aoki et al.

(10) Patent No.: US 8,641,441 B2
(45) Date of Patent: Feb. 4, 2014

(54) CONNECTOR

(75) Inventors: Eiji Aoki, Makinohara (JP); Motoo Nojima, Tokyo (JP)

(73) Assignee: Yazaki Corporation, Tokyo (JP)

( * ) Notice: Subject to any disclaimer, the term of this patent is extended or adjusted under 35 U.S.C. 154(b) by 125 days.

(21) Appl. No.: 13/497,548

(22) PCT Filed: Jun. 13, 2011

(86) PCT No.: PCT/JP2011/063540

§ 371 (c)(1),
(2), (4) Date: Mar. 22, 2012

(87) PCT Pub. No.: WO2011/158809

PCT Pub. Date: Dec. 22, 2011

(65) Prior Publication Data

US 2012/0270430 A1 Oct. 25, 2012

(30) Foreign Application Priority Data

Jun. 15, 2010 (JP) ..... 2010-135910

(51) Int. Cl.
*H01R 13/40* (2006.01)

(52) U.S. Cl.
USPC ..... 439/345; 439/587

(58) Field of Classification Search
USPC ..... 439/345, 626, 587
See application file for complete search history.

(56) References Cited

U.S. PATENT DOCUMENTS

| | | | | |
|---|---|---|---|---|
| 5,810,610 | A | 9/1998 | Kobayashi et al. | |
| 7,097,498 | B2 * | 8/2006 | Miyazaki | 439/559 |
| 7,618,286 | B2 * | 11/2009 | Aoki et al. | 439/587 |
| 7,749,025 | B2 * | 7/2010 | Aoki et al. | 439/607.41 |
| 8,342,880 | B2 * | 1/2013 | Kato et al. | 439/595 |
| 8,393,911 | B2 * | 3/2013 | Aoki et al. | 439/272 |
| 8,425,256 | B2 * | 4/2013 | Aoki et al. | 439/620.26 |

FOREIGN PATENT DOCUMENTS

| | | | |
|---|---|---|---|
| JP | 950833 | A | 2/1997 |
| JP | 2001250598 | A | 9/2001 |
| JP | 2002270254 | A | 9/2002 |
| JP | 2006271130 | A | 10/2006 |

OTHER PUBLICATIONS

International Search Report dated Jul. 26, 2011 issued in International Application No. PCT/JP2011/063540 (PCT/ISA/210).
Written Opinion dated Jul. 26, 2011 issued in International Application No. PCT/JP2011/063540 (PCT/ISA/237).

* cited by examiner

*Primary Examiner* — Xuong Chung Trans
(74) *Attorney, Agent, or Firm* — Sughrue Mion, PLLC

(57) ABSTRACT

A connector includes a housing, a cavity formed in the housing, a terminal to which a cable is connected and which is inserted into the cavity from a rear end side of the housing, and a nut held at a front end portion of the housing, wherein the terminal has a plate-like connection portion extended in an insertion direction to the cavity and an insertion hole formed in the connection portion, and the connection portion, which is inserted into the cavity and protruded from a front end portion of the housing, is bent and arranged along a front end surface of the housing, whereby the insertion hole is communicated with an internal thread of the nut.

3 Claims, 7 Drawing Sheets

(a)

(b)

(c)

CONNECTOR

TECHNICAL FIELD

The present invention relates to a connector with terminals each of which is connected to a cable.

BACKGROUND ART

Until now, such a terminal has been known that an electric wire press-fitted portion which is press-fitted to an electric wire and a connection portion in which a fitting hole is formed are provided, an internal thread is formed in the fitting hole, and this terminal is connected to an opposing terminal by screwing a bolt into the internal thread (see Patent Literature 1, for example).

Also, such another terminal has been known that an outer shell portion is formed on a connection portion and then a nut formed as a separate body is fixed onto this outer shell portion, so that an increase in a manufacturing cost due to the cutting process of an internal thread is suppressed (see Patent Literature 2, for example).

PRIOR ART LITERATURE

Patent Literature

Patent Literature 1: JP-A-2002-270254
Patent Literature 2: JP-A-2001-250598

SUMMARY OF THE INVENTION

Problems to be Solved by the Invention

As described above, in the terminal constructed such that the internal thread is formed in the connection portion or the nut is attached to the outer shell portion formed thereon, the connection portion is increased in size. In this event, when the connector is constructed that this terminal is inserted from the rear end side of a housing, there must be provided a large cavity into which the terminal is inserted to pass it through. As a result, an increase in size of the connector is brought about.

Also, in order to prevent such a situation that the terminal being inserted from the rear end side comes out of the housing in the direction opposite to the insertion direction, a lance acting as a retaining portion to retain the terminal must be provided to the housing. As a result, a further increase in size of the connector is brought about, and also an increase in cost due to complication of the structure is brought about.

The present invention has been made in view of the above circumstances, and it is an object of the present invention to provide a connector that is capable of reducing a size while suppressing a cost to the utmost.

Means for Solving the Problems

In order to attain the above object, the connector according to the present invention has following aspects (1) to (3) as features.

(1) There is provided a connector, which includes a housing, a cavity formed in the housing, a terminal that is connected to a cable and is inserted into the cavity from a rear end side of the housing, and a nut held at a front end portion of the housing, and the terminal has a plate-like connection portion extended in an insertion direction to the cavity and an insertion hole formed in the connection portion, and the connection portion, which is inserted into the cavity and protruded from the front end portion of the housing, is bent so as to be arranged along a front end surface of the housing so that the insertion hole is communicated with an internal thread of the nut.

(2) In the connector constructed as in above (1), a waterproofing plug is provided to the cable, and the waterproofing plug is engaged with the cavity to make watertight an inside of the cavity in a state that the terminal is inserted into the cavity.

(3) In the connector constructed as in above (1) or (2), a retaining claw is provided on the front end surface of the housing to retain and hold the connection portion of the terminal.

By the connector constructed as in above (1), the nut is held at the front end surface of the housing, and the plate-like connection portion protruded from the front end portion of the housing is bent and then arranged along the front end surface of the housing after the terminal is inserted into the cavity. Therefore, in comparison with the connector having such a configuration that the terminal, in which the internal thread is formed or onto which the nut is fixed, is inserted into the cavities of the housing, the cavity can be reduced in size, and thus a reduction in size of the connector can be achieved. Also, the connection portion of the terminal protruded from the front end portion of the housing is bent and arranged along the front end surface of the housing. Therefore, the disengagement of the terminal can be prevented by engaging the connection portion with the housing, and therefore an increase in size and an increase in cost due to the provision of the complicated shape can be suppressed.

By the connector constructed as in above (2), a size of the cavity can be reduced. Therefore, a reduction in size of the waterproofing plug that blocks the cavity to make watertight an inside of the cavity can be achieved, and a reduction in cost can be achieved.

In the connector constructed as in above (3), the connection portion of the terminal is retained and held by the retaining claw on the front end surface of the housing. Therefore, when the terminal is to be connected to the terminal of the opposing connector by the bolts, the bolt can be passed smoothly through the insertion hole of the connection portion of the terminal respectively and then this bolt can be screwed into the nut respectively, and thus the terminals of both connectors can be engaged mutually and connected satisfactorily.

Advantages of the Invention

According to the present invention, the connector that is capable of reducing a size while suppressing a cost to the utmost can be provided.

With the above, the present invention is concisely explained. Further, when "Mode for Carrying Out the Invention" to be explained hereinafter is read through with reference to the accompanying drawings, details of the present invention will be made clear much more.

MODE FOR CARRYING OUT THE INVENTION

An example of an embodiment according to the present invention will be explained with reference to the drawings hereinafter.

Figure 1:
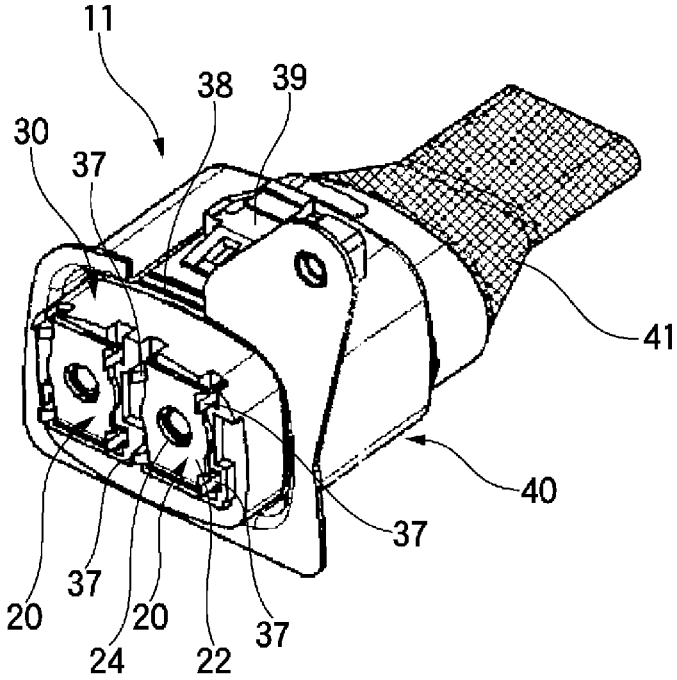
FIG. 1 is a perspective view of a connector according to an embodiment of the present invention.
Figure 2:
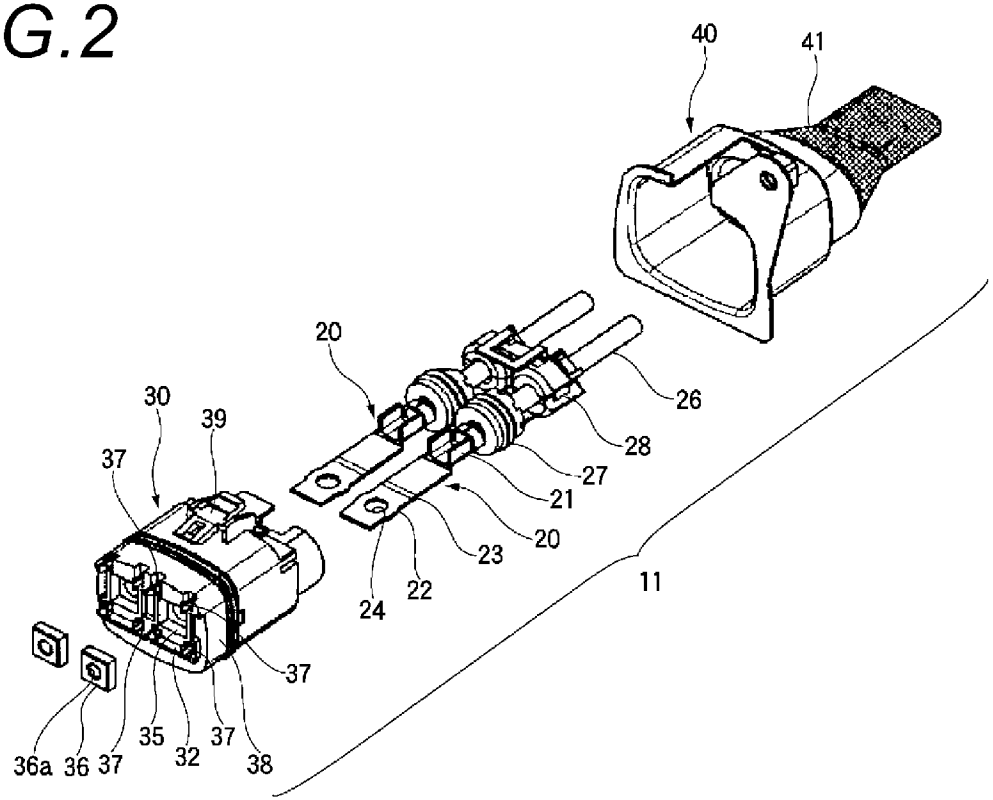
FIG. 2 is an exploded perspective view of the connector according to the embodiment of the present invention.
Figure 3:
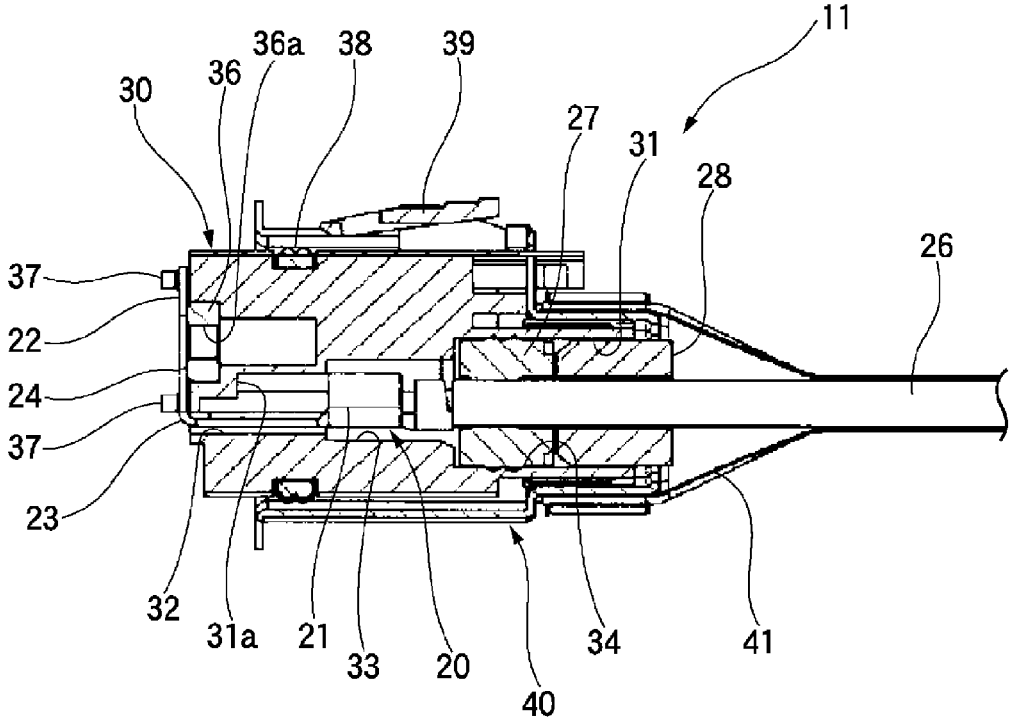
FIG. 3 is a sectional view of the connector according to the embodiment of the present invention.
Figure 4:
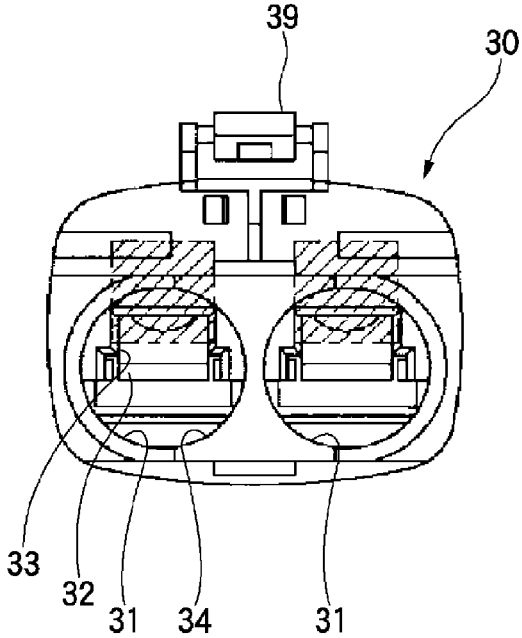
FIG. 4 is a rear view of a housing constituting the connector according to the embodiment of the present invention.

FIG. 1 is a perspective view of a connector according to an embodiment of the present invention, FIG. 2 is an exploded perspective view of the connector according to the embodiment of the present invention, FIG. 3 is a sectional view of the connector according to the embodiment of the present invention, and FIG. 4 is a rear view of a housing constituting the connector according to the embodiment of the present invention.

As shown in FIG. 1 to FIG. 3, a connector 11 includes a plurality of terminals 20, a housing 30 in which these terminals 20 are housed, a shielding shell 40 for covering this housing 30, and a shielding member 41 for covering the housing 30 and cables 26, which are exposed from the rear end of the housing 30.

The terminals 20 are formed by applying the press working to a conductive metal material such as a copper plate, or the like. Each of the terminals 20 has a press-fitted portion 21 located on the rear end side, and a plate-like connection portion 22 extended toward the insertion direction to a cavity 31 that is formed in the housing 30 and is described later. A conductor of the cable 26 is press-fitted and fixed to the press-fitted portion 21 and is connected electrically thereto. The connection portion 22 has a bent portion 23, which is bent toward one surface side, in its middle portion. Also, an insertion hole 24 is formed in the connection portion 22 between a top end of the connection portion 22 and the bent portion 23.

A cylindrical rubber plug (waterproofing plug) 27 is fitted to the cable 26, which is connected to this terminal 20, on the terminal 20 side. Also, a rear holder 28 is provided on the opposite side to the terminal 20 more away from the terminal than the rubber plug 27. The rubber plug 27 makes watertight between the housing 30 and the cable 26, and the rear holder 28 holds the rubber plug 27 in a predetermined position.

The housing 30 is formed by an insulating resin material, and has a plurality of cavities 31 in each of which the terminal 20 is housed, as shown in FIG. 4.

Each of these cavities 31 has in sequence a connection portion insertion hole 32 through which the connection portion 22 of the terminal 20 is passed, a press-fitted portion containing hole 33 in which the press-fitted portion 21 of the terminal 20 is arranged, and a rubber plug containing hole 34 in which the rubber plug 27 and the rear holder 28 are contained, from the top end side. A wall portion formed at a boundary between the connection portion insertion hole 32 and the press-fitted portion containing hole 33 is used as an insertion restricting wall 31*a* that restricts the insertion of the terminal 20.

Then, the terminal 20 that is not bent yet is inserted into each of the cavities 31 from the rear end side of the housing 30. When the rubber plug 27 is fitted into the rubber plug containing hole 34, this rubber plug 27 comes liquid-tightly into contact with the inner peripheral surface of the rubber plug containing hole 34 in the cavity 31. Accordingly, the part of the cavity 31 located on the forwarder side than the fitting location of the rubber plug 27 is made waterproof.

Nut holding recess portions 35 are formed on a front end surface of the housing 30. An internal thread 36*a* is formed in a center of a nut 36 that is shaped into a rectangular shape when viewed from the top. This nut 36 is housed and held in the nut holding recess portions 35 respectively.

The bent top end sides of the connection portions 22 are arranged on the front end surface of this housing 30. The insertion hole 24 formed in the connection portion 22 is placed in communication with the internal thread 36*a* of the nut 36 that is housed in the nut holding recess portion 35.

A retaining claw 37 is formed at upper and lower corners on both sides of the nut holding recess portions 35 on the front end surface of the housing 30 respectively. The connection portions 22 that are arranged along the front end surface of the housing 30 respectively are retained and held by these retaining claws 37.

Also, a packing member 38 is provided to the outer periphery of the housing 30 all around the entire circumference. This packing member 38 comes into tight contact with the opposing connector to seal it. Also, a locking mechanism portion 39 is provided to a top portion of the housing 30. When the connector 11 is connected to the opposing connector, this locking mechanism portion 39 engages with the opposing connector to keep the connected state.

The shielding shell 40 is formed of conductive metal material, and is fitted onto the housing 30 from its rear end side to cover the periphery of the housing 30. Also, the shielding member 41 formed of conductive material is provided to the rear end side of the shielding shell 40. The housing 30 and the cables 26 both exposed at the rear end of the shielding shell 40 are covered with this shielding member 41. Then, the connector 11 is shielded with the shielding shell 40 and the shielding member 41.

In the above connector 11, in the state that this connector 11 is connected to the opposing connector, the bolt that is inserted into the insertion holes, which are formed in the terminals of the opposing terminal, is screwed into the internal threads 36*a* of the nuts 36 respectively. Accordingly, the terminals 20 of the connector 11 and the terminals of the opposing connector are coupled together and are connected conductively to each other.

Figure 5:
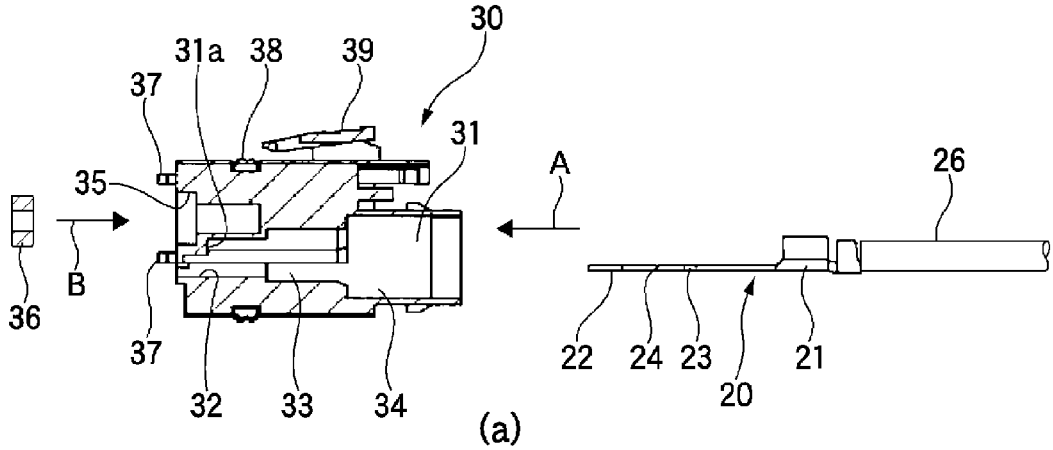
FIG. 5(*a*) to FIG. 5(*c*) are sectional views explaining procedures of assembling the connector respectively.
Figure 5:
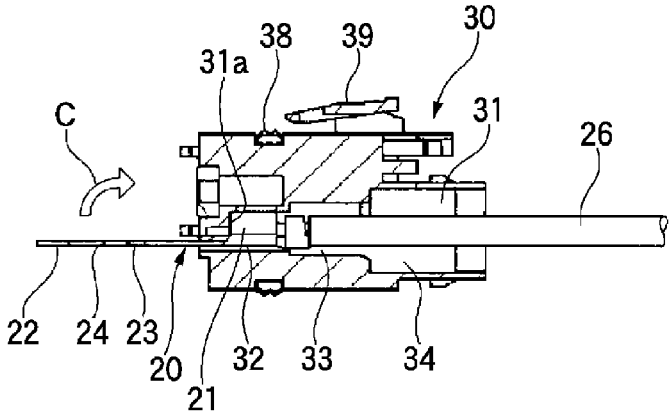
Figure 5:
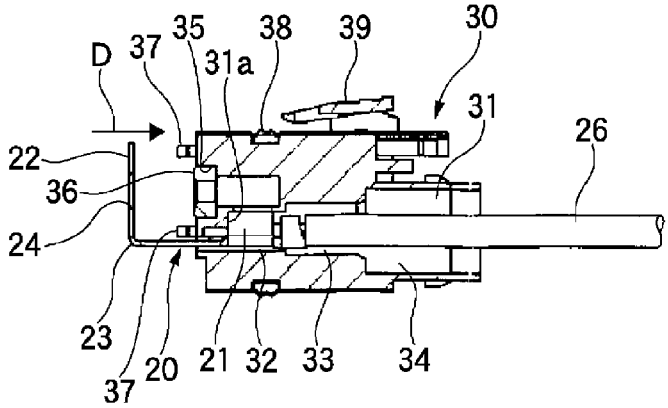

Next, the case where the above connector 11 is assembled will be explained hereunder. FIG. 5(*a*) to FIG. 5(*c*) are sectional views explaining the procedures of assembling the connector respectively.

As shown in FIG. 5(*a*), the terminal 20 that is not bent yet is inserted into the cavities 31 of the housing 30 from the rear end side respectively, as indicated with an arrow A in FIG. 5(*a*). Then, the press-fitted portion 21 comes into contact with the insertion restricting walls 31*a* respectively. Accordingly, the insertion of the terminal 20 into the cavity 31 is restricted, and thus the excessive insertion of the terminal 20 is prevented. As a result, the connection portions 22 each containing the bent portion 23 are set to their protruded state from the front end portion of the housing 30.

Then, the nut 36 is fitted into the nut holding recess portions 35 on the front end surface of the housing 30 respectively, as indicated with an arrow B in FIG. 5(*a*). Thus, the nuts 36 are held at the front end portion of the housing 30.

As shown in FIG. 5(*b*), the connection portions 22 are bent by about 90° at the bent portion 23 respectively, as indicated with an arrow C in FIG. 5(*b*), in the state that the connection portions 22 of the terminals 20 are protruded sufficiently from the top end of the housing 30.

As shown in FIG. 5(*c*), after the connection portions 22 are bent at the bent portion 23 respectively, the terminals 20 are pulled back toward the rear end side in the opposite direction to the insertion direction, as indicated with an arrow D in FIG. 5(*c*).

By doing this, the connection portions 22 being bent at the bent portion 23 respectively are positioned along the front end surface of the housing 30 to cover the nut 36 respectively, and the insertion holes 24 are placed in communication with the internal threads 36*a* of the nuts 36 respectively. Then, the connection portions 22 of the terminals 20 are retained and held by the retaining claws 37, which are provided to the front end surface of this housing 30, respectively.

After this, the rubber plug 27 and the rear holder 28, through which the cable 26 is passed in advance respectively, are fitted into the rubber plug containing holes 34 of the cavities 31 respectively. Then, the shielding shell 40 is fitted onto the housing 30, and then the rear end of the housing 30 and the cables 26 are covered with the shielding member 41.

As explained above, according to the connector according to the above embodiment, the nuts 36 are held on the front end surface of the housing 30, and the plate-like connection portions 22, each of which is inserted into the cavity 31 and is protruded from the front end portion of the housing 30, are bent and positioned along the front end surface of the housing 30. As a result, in comparison with the connector having such a configuration that the terminal in which the internal thread is formed or onto which the nut is fixed is inserted into the cavities of the housing respectively, the cavity can be reduced in size, and thus a reduction in size of the connector can be attained. Also, the connection portions 22 of the terminals 20 protruded from the front end portion of the housing 30 are bent and arranged along the front end surface of the housing 30. As a result, disengagement of the terminals 20 can be prevented by causing the connection portions 22 to engage with the housing 30 respectively, and also an increase in size and an increase in cost caused due to the provision of the lance of a complicated shape can be suppressed.

Also, the cavity 31 can be reduced in size. Therefore, the rubber plug 27 for blocking the cavity 31 to make it watertight can be reduced in size, and a reduction in cost of the cavity 31 can be attained.

Further, the connection portions 22 of the terminals 20 are retained and held by the retaining claws 37 on the front end surface of the housing 30 respectively. Therefore, when the terminals 20 are connected to the terminals of the opposing connector by the bolts, the bolt can be passed smoothly through the insertion holes 24 of the connection portions 22 of the terminals 20 respectively and then this bolt can be screwed into the nuts 36 respectively. Accordingly, the terminals of both connectors can be engaged satisfactorily and be connected mutually.

Here, in order to explain further superiority of the present invention, a reference example is shown in FIG. 6 to FIG. 9 hereunder.

Figure 6:
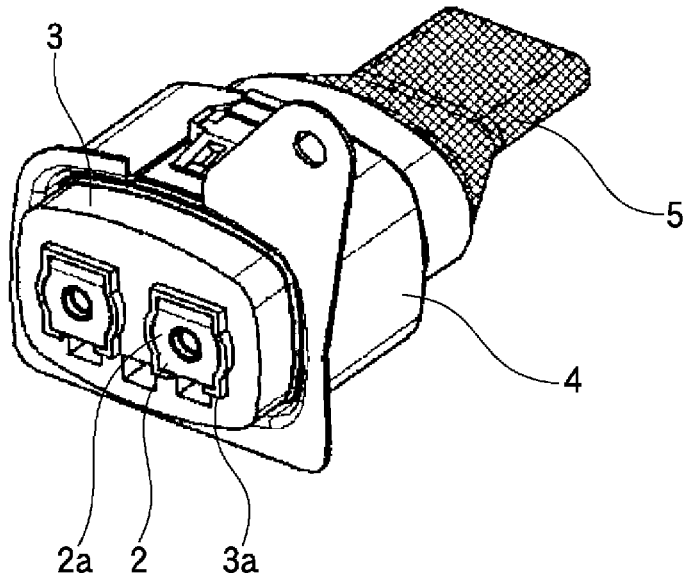
FIG. 6 is a perspective view of a connector in a reference example.
Figure 7:
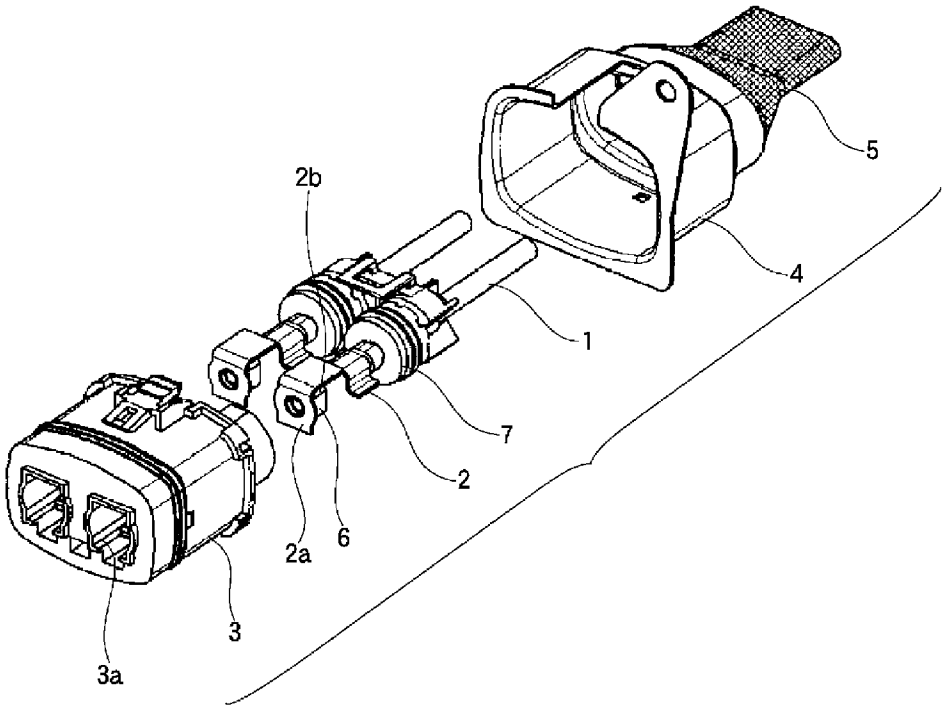
FIG. 7 is an exploded perspective view of the connector in the reference example.
Figure 8:
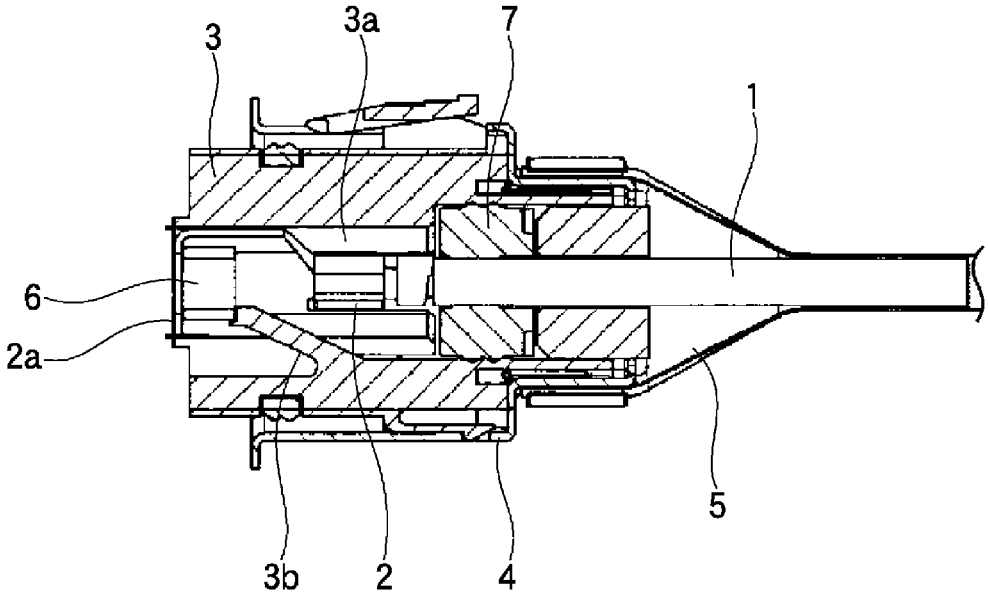
FIG. 8 is a sectional view of the connector in the reference example.
Figure 9:
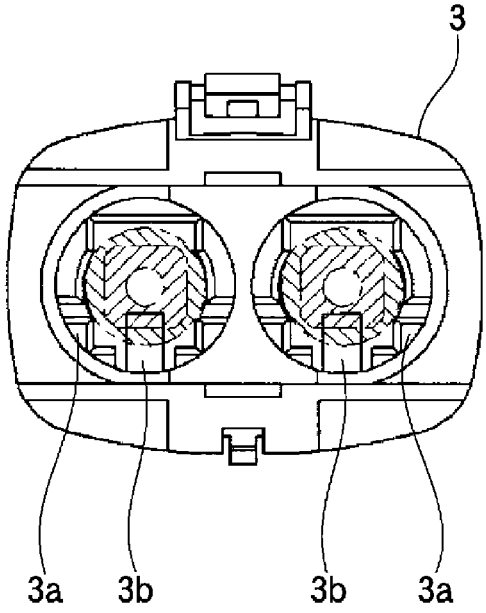
FIG. 9 is a rear view of a housing constituting the connector in the reference example.

FIG. 6 is a perspective view of a connector in a reference example, FIG. 7 is an exploded perspective view of the connector in the reference example, FIG. 8 is a sectional view of the connector in the reference example, and FIG. 9 is a rear view of a housing constituting the connector in the reference example.

As shown in FIG. 6 to FIG. 9, the connector in the reference example includes terminals 2 to each of which a cable 1 is connected, a housing 3 having cavities 3*a* into each of which the terminal 2 is inserted from the rear end side, a shielding shell 4 fitted to cover the housing 3, and a shielding member 5 for covering the housing 3 and the cables 1 both exposed at the rear end of the shielding shell 4.

A nut press-fitted portion 2*b* is formed at connection portions 2*a* of the terminals 2 respectively, and a nut 6 is fitted to the nut press-fitted portions 2*b* with pressure and is held thereon respectively.

In such connector, the connection portion 2*a* of the terminal 2 that holds the nut 6 is increased in size. Therefore, because the large connection portion 2*a* should be inserted into the cavity 3*a* and be passed through there, the cavity 3*a* of the housing 3 must also be increased in size.

Also, in order to prevent the disengagement of the terminals 20 inserted into the cavity 3*a*, lances 3*b* must be provided to the housing 3.

As a result, this connector needs the large cavity 3*a* and also the lance 3*b* must be provided. Therefore, an increase in size of the connector is brought about. Also, according to an increase in size of a rubber plug 7, which blocks the cavity 3*a* to make it watertight, and complication of the configuration due to the provision of the lances 3*b*, an increase in cost is brought about.

Here, the present invention is not limited to the above embodiment, and variations, improvements, and the like can be applied appropriately. In addition, material, shape, dimension, number, arranged location, etc. of respective constituent elements in the above embodiment may be chosen arbitrarily if these elements can attain the present invention, and are not limited.

The present invention is explained in detail with reference to the particular embodiment. But it is obvious for these skilled in the art that various variations and modifications can be applied without departing a spirit and a scope of the present invention.

This application is based upon Japanese Patent Application (Patent Application No. 2010-135910) filed on Jun. 15, 2010; the entire contents of which are incorporated herein by reference.

INDUSTRIAL APPLICABILITY

According to the present invention, the connector that is capable of reducing a size while suppressing a cost to the utmost can be provided.

DESCRIPTION OF REFERENCE NUMERALS

11 connector
20 terminal
22 connection portion
24 insertion hole
26 cable
27 rubber plug (waterproofing plug)
30 housing
31 cavity
36 nut
36*a* internal thread
37 retaining claw

The invention claimed is:

1. A connector comprising:

a housing;

a cavity formed in the housing;

a terminal that is connected to a cable and is inserted into the cavity from a rear end side of the housing; and a nut held at a front end portion of the housing, wherein the terminal has a plate-like connection portion extended in an insertion direction to the cavity and an insertion hole formed in the connection portion, and the connection portion, which is inserted into the cavity and protruded from the front end portion of the housing, is bent so as to be arranged along a front end surface of the housing so that the insertion hole is communicated with an internal thread of the nut.

2. The connector according to claim 1, wherein a waterproofing plug is provided to the cable; and wherein the waterproofing plug is engaged with the cavity to make watertight an inside of the cavity in a state that the terminal is inserted into the cavity.

3. The connector according to claim 1, wherein a retaining claw is provided on the front end surface of the housing to retain and hold the connection portion of the terminal.

* * * * *